US005107875A

United States Patent [19]

Sundholm

[11] Patent Number: 5,107,875

[45] Date of Patent: Apr. 28, 1992

[54] APPARATUS FOR FLUSHING OF HYDRAULIC PIPE SYSTEMS OR THE LIKE

[76] Inventor: Göran Sundholm, Tiilikanoja, Rantatie, SF-04310 Tuusula, Finland

[21] Appl. No.: 582,949

[22] PCT Filed: Apr. 21, 1989

[86] PCT No.: PCT/FI89/00073

§ 371 Date: Oct. 11, 1990

§ 102(e) Date: Oct. 11, 1990

[87] PCT Pub. No.: WO89/10214

PCT Pub. Date: Nov. 2, 1989

[30] Foreign Application Priority Data

Apr. 29, 1988 [FI] Finland ..... 882024

[51] Int. Cl.[5] ..... B08B 3/04

[52] U.S. Cl. ..... 134/99; 134/111; 134/166 C; 134/169 C; 134/184

[58] Field of Search ..... 134/99, 111, 166 C, 134/167 C, 168 C, 171, 184, 22.12; 92/174

[56] References Cited

U.S. PATENT DOCUMENTS

| | | | |
|---|---|---|---|
| 918,091 | 4/1909 | Roche | 134/168 C |
| 2,028,972 | 1/1936 | Fessler | 134/168 CX |
| 2,204,900 | 6/1940 | Lowry | 134/168 CX |
| 3,182,670 | 5/1965 | Howell . | |
| 4,874,002 | 10/1989 | Sundholm | 134/111 |
| 4,991,610 | 2/1991 | Huber et al. | 134/195 X |

*Primary Examiner*—Frankie L. Stinson
*Attorney, Agent, or Firm*—Ladas & Parry

[57] ABSTRACT

The invention relates to an apparatus for flushing hydraulic pipe systems of so called normal size. Between the pipe system (1) and a hydraulic aggregate (2) a dual cylinder (8) is connected, having a common piston shaft (12) such that when the hydraulic aggregate (2) pumps pressure fluid into one of the chamber parts (15, 16) containing the piston shaft (12), the other corresponding chamber part (16, 15) and one (13) of the two outer chamber parts (13, 14) feeds in flushing fluid to the inlet (6) of the pipe system (1) while the other (14) of the outer chamber parts receives fluid from the outlet of the pipe system (1) through a filter (23) and the remainder of the outlet flow is directed back to the hydraulic aggregate (2). In this manner, a flushing volume considerably exceeding the volume capacity of the hydraulic aggregate (2) is attained.

6 Claims, 2 Drawing Sheets

APPARATUS FOR FLUSHING OF HYDRAULIC PIPE SYSTEMS OR THE LIKE

The present invention relates to an apparatus for flushing hydraulic pipe systems or the like.

Hydraulic and other similar pipe systems must be cleaned internally from contaminating particles remaining after the installation before they are taken into use, said particles otherwise causing serious disruptions later on.

In accordance with the commonly adopted apprehension among those skilled in the art, achieving a satisfactory flushing result requires that the flushing is carried out with so high a flow volume that a turbulent flow is produced, i.e. one must attain a Reynolds's Number of approximately 4000.

In the so called normal hydraulics, by which one understands pipe systems of a relatively small extension and medium-size pipe diameters, up to about 50 mm, flow volumes of approximately 300 to 400 liters per minute are required. Hydraulic aggregates are in fact available, but they are sizeable and expensive, which involves unreasonably high costs in flushing the hydraulic systems, especially since the flushing is a so called one-time operation.

For this reason, one has mostly confined oneself to performing the flushing with smaller hydraulic aggregates normally available on the site, said aggregates having a flow volume of about 100 to 150 liters per minute, whereby one does not achieve a turbulent flow but only a laminar flow whose cleaning effect is nearly non-existent, or else one has simply refrained from carrying out any flushing. The result has been that serious disruptions in operation have subsequently developed.

The object of the present invention is to provide a novel apparatus permitting effective cleaning of hydraulic and other similar pipe systems of so called normal size, utilizing hydraulic aggregates already present on the site.

The apparatus of the invention is mainly characterized in that a bipartite cylinder structure is connected between the pipe system and the hydraulic aggregate known per se, said cylinder structure comprising a piston shaft common to both parts of the cylinder structure, and having a piston in each part for providing four cylinder chambers, of which two chambers have a smaller cross-section than the two other chambers, that the two cylinder chambers having a smaller cross-section are arranged to be alternately connected to the outlet of the hydraulic aggregate, whereby in each case the smaller cylinder chamber which is not connected to the hydraulic aggregate and one of the larger cylinder chambers are connected to the inlet of the pipe system whilst the other one of the larger cylinder chambers is connected to the outlet of the pipe system through a filter, and that immediately downstream from the filter a branch line is provided, preferably under a certain back pressure, to convey part of the flushing fluid back into the hydraulic aggregate.

The cylinder, including the filter, comprised by the invention can advantageously be constructed as a single unit, termed flushing unit in the following. Only this flushing unit needs to be transported to and from the pipe system to be flushed clean. The flushing unit is small and inexpensive and its use requires no special professional skill. Neither is one dependent on the supply of electric current, and the invention is therefore well suited to the flushing of e.g. excavating machinery or the like located outdoors in a terrain that is difficult of access, and in that case the hydraulic aggregates of the machinery can be used.

E.g. a hydraulic trunk line of a papermaking machine or the trunk line for the cargo pumps on a tank vessel or other similar systems having a number of branch loops, each of which constitutes a hydraulic pipe system as contemplated in the present application, can also serve as the hydraulic aggregate. The loops in question can be flushed clean also during the normal operation of the main system by connecting in each case a flushing unit between the trunk line and the branch loop.

On account of the fact that part of the flushing flow is constantly recycled to the reservoir of the hydraulic aggregate, one achieves even less susceptibility to the ambient temperature; both overheating and undesired cooling can be avoided to a great extent.

The invention is explained more closely in the following with reference to the accompanying drawing which, by way of example, shows a preferred embodiment of the invention.

Figure 1:
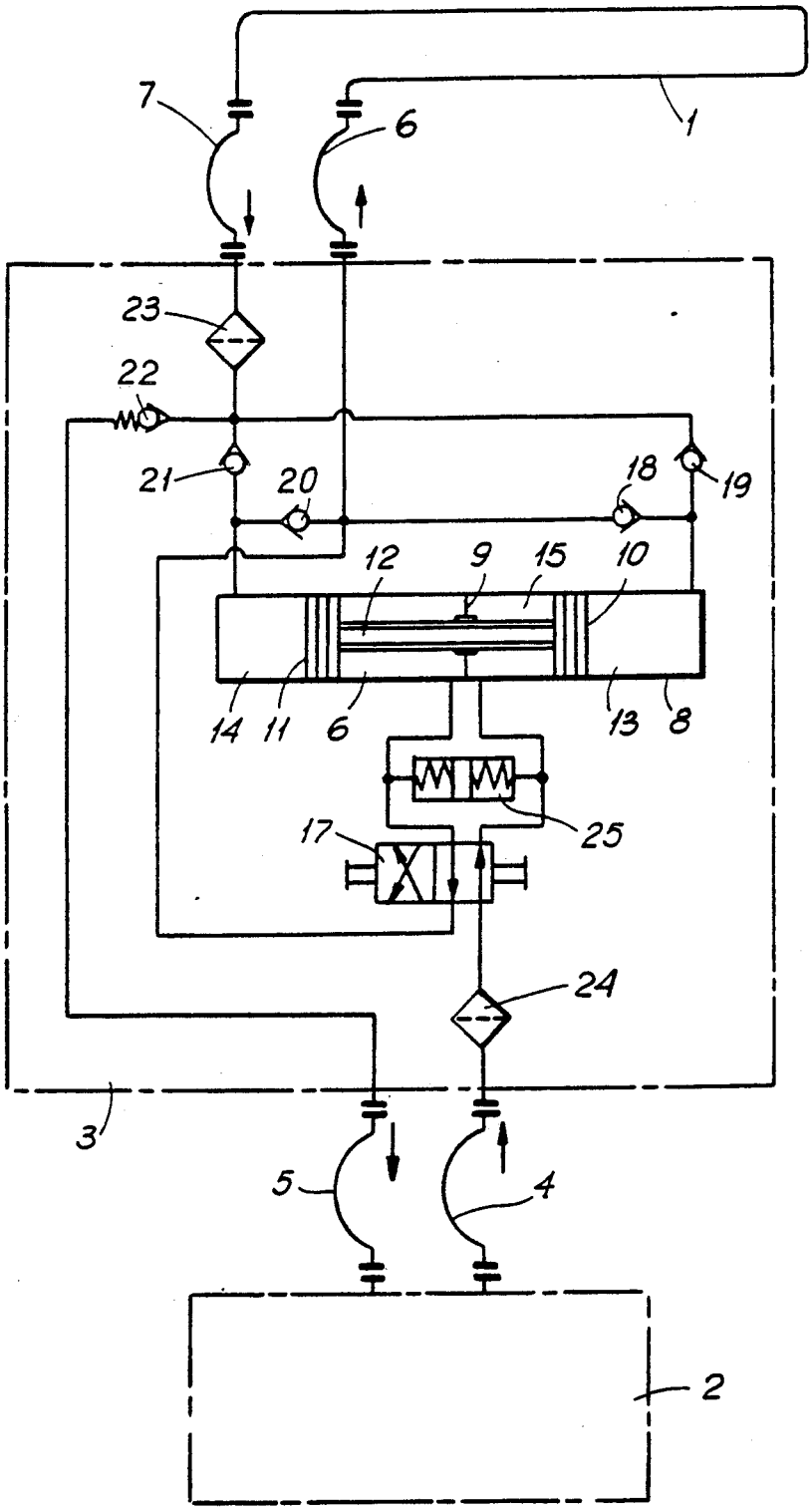
FIG. 1 shows the invention in the form of a circuit diagram.

In FIG. 1, the reference numeral 1 denotes a pipe system to be flushed clean, 2 denotes a drive unit, e.g. a conventional hydraulic aggregate. The flushing unit encompassed by the invention is drawn with a dotted line as a block and is denoted by 3. The connections from the hydraulic aggregate 2 to and from the flushing unit 3 are denoted by 4 and 5, and the connections from the flushing unit 3 to and from the pipe system 1 are denoted by 6 and 7.

The flushing unit 3 includes a cylinder 8 preferably of a uniform thickness, divided by a partition wall 9 into two halves. Each half has a movable piston 10 and 11, said pistons being installed on a common piston shaft 12 movable through the partition wall 9. The cylinder chambers exterior of the pistons 10 and 11 are denoted by 13 and 14, and the annular cylinder chambers between the pistons and the partition wall 9 are denoted by 15 and 16. 17 denotes a pilot valve for conducting oil from the hydraulic aggregate 2 to either the cylinder chamber 15 or the cylinder chamber 16; in the position shown in the drawing the valve 17 conducts oil to the cylinder chamber 15. 18–22 denote non-return valves, of which valve 22 has a certain back pressure, for example 3 bar. 23 denotes a filter for removing contaminations from the flushing fluid issuing from the pipe system 1, 24 denotes a filter in the pressure line from the aggregate 2 to the valve 17.

The apparatus according to the invention operates in the following manner:

Initially the entire pipe system 1 and the flushing unit 3 are filled with flushing fluid, normally oil. When the pipe system and flushing unit—including the cylinder 8 and the connecting piping—are filled, the hydraulic aggregate 2 is brought into the so called normal drive, which can typically mean an outlet flow volume of up to 100 liters per minute and a working pressure of up to 200 bar.

When valve 17 is brought to the position shown in FIG. 1, oil flows from the hydraulic aggregate 2 into the cylinder chamber 15, and then the piston 10 is driven to its extreme position to the right in FIG. 1.

During its motion toward this extreme position, the piston 10 displaces oil out from the cylinder chamber 13 into the pipe system 1 through the non-return valve 18 and the connection 6. Part of the return flow from the pipe system 1 through the connection 7 and filter 23 goes through the non-return valve 21 to the cylinder chamber 14 exterior of the piston 11 in the cylinder 8 and the remainder through non-return valve 22 and connection 5 to the reservoir of the hydraulic aggregate 2.

When the piston 10 has reached its extreme position to the right, the pilot valve 17 is moved to the right from the position shown in FIG. 1, and then oil from the hydraulic aggregate 2 flows into the cylinder chamber 16 and the piston 11 starts being driven to the left. Then oil is pressed out from the cylinder chamber 14 through valve 20 and connection 6 to the pipe system 1, and likewise from the cylinder chamber 15 through valve 17. Part of the return flow through filter 23 now goes through the non-return valve 19 to fill the cylinder chamber 13 whilst the piston 10 moves toward the left, and the remainder flows through the non-return valve 22 to the reservoir of the hydraulic aggregate 2.

Valve 17 is preferably arranged to extend through the partition wall 9 of the cylinder 8, and in that case the pistons 10 and 11 attend to the change-over of the valve 17 when the respective piston reaches the partition wall 9. A preferred embodiment of this type is shown in FIG. 2 and will be described more closely in the following.

Valve 17 comprises a centrally disposed pressure opening 30 and two return openings 31 and 32, one on either side of the pressure opening. In the partition wall 9, there is a bore for a stem 33 close up to the wall of the cylinder 8, said bore having annular recesses 34 for the openings 30, 31 and 32. The stem 33 has a medial shoulder 35 bearing against the wall of the bore and two corresponding end shoulders 36. The stem 33 has at each end an axial bore 37 whose bottom lies approximately on level with the medial shoulder 35 of the stem. Between the medial shoulder 35 and end shoulders 36 the stem 33 has narrower portions including openings 38 to the respective axial bore 37.

Figure 2:
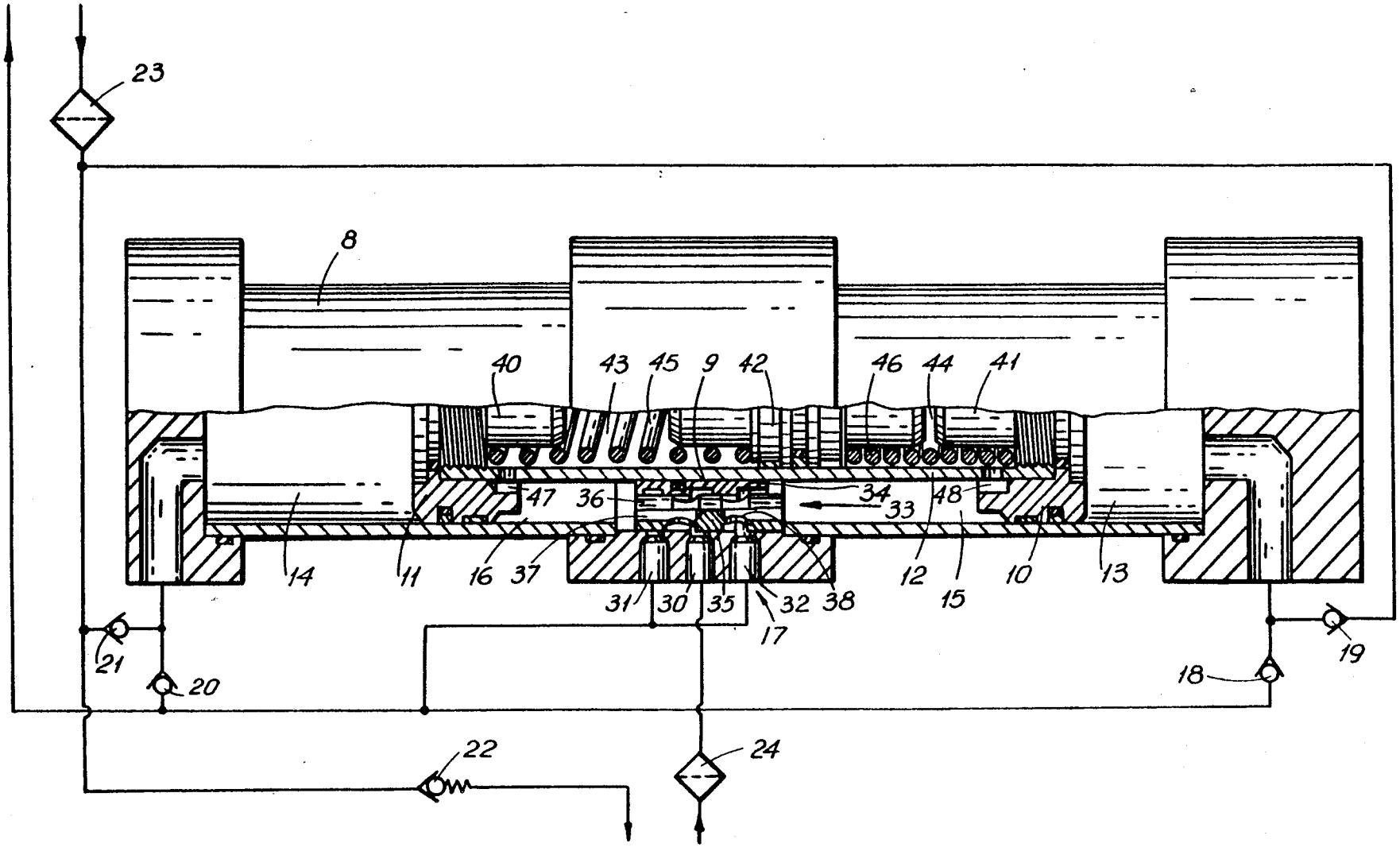
FIG. 2 shows a preferred embodiment of the cylinder structure, partly in a longitudinal section.

In the situation shown in FIG. 2, the stem 33 is moved to the right and extends within the cylinder chamber 15, whereby the pressure fluid flows from the opening 30 into the chamber 16 and drives the piston 11 toward the left. The left end shoulder 36 of the stem 33 shuts the connection from the chamber 16 to the return opening 31 whilst the corresponding connection from the chamber 15 to the return opening 32 is open.

The piston 10 also moves toward the left until it encounters the stem 33 to move it to its extreme left position wherein the connections from the pressure opening 30 to the chamber 15 and from the return opening 31 to the chamber 16 are open whilst the return connection from the chamber 15 is shut. The pistons 10 and 11 move to the right until the piston 11 again moves the stem 33 to its extreme right position, and so on.

However, during the motion of the stem 33 from extreme position to extreme position, the medial shoulder 35 will momentarily shut the pressure opening 30 completely, and likewise both of the return openings 31 and 32 are momentarily shut by the end shoulders 36, in which connection the stem 33 will strongly tend to "get stuck" at this dead point and interrupt the operation of the entire apparatus.

To secure a continuous function, certain additional energy is needed to bring the stem 33 past the dead point. The preferred embodiment shown in the drawing includes for this purpose an accumulator which is denoted in FIG. 1 by the number 25 and whose construction is shown in detail in FIG. 2.

The piston shaft 12 is constituted by a pipe having two fixed ends 40 and 41 between which a piston 42 has been movably fitted. 43 and 44 denote two cylinder chambers between the piston 42 and the respective ends 40, 41. In each chamber 43 and 44 a spiral spring 45 and 46 is fitted, the ends of said spring being in abutment against the piston 42 and the respective end 40, 41. The piston 42 and the ends 40, 41 preferably also have pins for guiding the ends of the spiral springs from within. Chamber 43 is connected with chamber 16 through an opening 47, and chamber 46 is connected with chamber 15 through an opening 48.

In the situation shown in FIG. 2, the pressure fluid flows from chamber 16 to chamber 43 and drives the piston 42 toward the right until the spring 46 in the chamber 44 is substantially compressed and in this way accumulates energy. When the stem 33 reaches its middle position, shutting the pressure opening 30, the pressure in the chambers 16 and 43 ceases, and the spring 46 is extended and pushes by means of the piston 42 more fluid, under the pressure of the spring 46, from the chamber 43 to the chamber 16, wherethrough the piston 11 is further driven to the left and through the intermediary of the piston 10 also moves the stem 33 further to the left past the dead point so that a connection from the pressure opening 30 to the chamber 15 is established. The fluid quantities driven by the spring 46 and the piston 42 from the chamber 43 are compensated by a corresponding fluid flow from the chamber 15 through the opening 48 into the chamber 44.

As soon as the pressure fluid through the opening 30 reaches the chambers 15 and 44, the piston 42 is driven to the left and accumulates energy in the spring 45 disposed in the chamber 43.

The advantage with the hydraulic accumulator 25; 40–48 described above is that the entire flushing apparatus can operate independently by means of a fully conventional hydraulic aggregate 2.

If one uses an electrically manoeuvered pilot valve 17 exterior of the cylinder 8, the stem 33 and the accumulator 25 can be omitted, but then a source of electrical energy, including the cables etc., is required, and on the other hand shock absorber means (well known per se) are required to decelerate the movement of the piston in the vicinity of the ends of the cylinder 8 so that the pistons 10 and 11 do not bang severely against the ends. During the decelerated end movement, part of the oil from the hydraulic aggregate 2 may be directed to flow into a pressure fluid accumulator provided with a membrane, said membrane being of a yielding construction and compressing a gas. After the piston 10, 11 has changed direction, the pressure fluid accumulator is emptied and it contributes to driving the piston forward. Such a procedure is also within the scope of the present invention, even though the procedure according to the drawing is preferred.

The flushing of the pipe system 1 is continued in the manner described in the foregoing until the system is clean.

In the following, the invention will be further illustrated by means of an example of the practical designing.

The hydraulic aggregate 2 can be assumed to have a capacity of 100 liters of oil per minute with a pressure of 200 bar. The cross-sectional surface of the cylinder chambers 13 and 14 shall be A1, and the cross-sectional surface of the cylinder chambers 15 and 16 shall be A2. The diameter of the piston shaft can be selected so that A1:A2=3.

Assuming these values, in the situation shown in the drawing the cylinder chamber 15 should be filled with 100 liters per minute, the cylinder chamber 16 emptied of 100 liters per minute, the cylinder chamber 16 emptied of 300 liters per minute and cylinder chamber 14 filled with 300 liters per minute. The flushing of the pipe system 1 takes place with 400 liters per minute, from chambers 13 and 16. 100 liters per minute flow through the non-return valve 22 back to the hydraulic aggregate 2, i.e. the same amount that it supplies. On account of the fact that the valve 22 has a certain back pressure, e.g. 3 bar, the risk of cavitation in the cylinder chambers 13 and 14 is eliminated.

If the working pressure of the hydraulic aggregate 2 is P1 and the back pressure which is produced by the flow resistance of the pipe system 1 and which is present in chambers 13 and 16 in the situation shown in the drawing is P2, the equation $$P1 \times A2 = P2(A1 + A2)$$

is realized.

Thus, assuming as in the foregoing that A1:A2=3, we have $$P1:P2 = 4.$$

The flushing of the pipe system 1 with 400 liters per minute should thus be possible to perform with a pressure of 50 bar.

The implementation shown in the drawing appears constructionally to be the most appropriate, but the details may naturally vary greatly within the scope of the inventive concept defined in the following claims.

I claim:

1. An apparatus for flushing a pipe system, characterized in that a bipartite cylinder structure (8) is connected between a pipe system (1) and an hydraulic aggregate (2), the cylinder structure comprising a piston shaft (12) common to both parts of the cylinder structure, and having a piston (10; 11) in each part for providing four cylinder chambers (13, 14, 15, 16), of which two chambers (15, 16) have a smaller cross-section than the two other chambers (13, 14), that the two cylinder chambers (15, 16) having the smaller cross-section are arranged to be alternately connected to an outlet (4) of the hydraulic aggregate (2), whereby in each case the smaller cylinder chamber which is not connected to the hydraulic aggregate (2) and one of the larger cylinder chambers (13, 14) are connected to an inlet (6) of the pipe system (1) whilst the other one of the larger cylinder chambers is connected to an outlet (7) of the pipe system (1) through a filter (23), and that immediately downstream from the filter (23) a branch line is provided to convey part of the flushing fluid back into the hydraulic aggregate (2).

2. Apparatus as claimed in claim 1, characterized in that the cylinder structure is constituted by a cylinder (8) having a partition wall (9) dividing the cylinder (8) into two halves and having a throughgoing piston shaft (12) with a piston (10, 11) at each end.

3. Apparatus as claimed in claim 2, characterized in that a pilot valve (17) is mounted in the partition wall (9), arranged to be responsive to the respective piston (10, 11) for alternately connecting the respective adjacent cylinder chamber (16, 15) to the outlet (4) of the hydraulic aggregate (2).

4. Apparatus as claimed in claim 3, characterized in that the pilot valve (17) comprises a stem (33) mounted in the partition wall (9) to be movable between two extreme positions and arranged to be actuated by the two pistons (10, 11) for alternate connection of the respective adjacent cylinder chamber (16, 15) to the outlet (4) of the hydraulic aggregate (2), that the piston shaft (12) has been made into a cylinder having a movable piston (42) dividing the cylinder into two chambers (43, 44), each in connection (47, 48) with the respective cylinder chamber (16, 15) adjoining the stem (33) mounted in the partition wall (9), and that a spring element (45, 46) is provided in each chamber (43, 44) within the piston shaft (12), in abutment against said piston (42) and the corresponding cylinder end (40, 41) to ensure the movement of the stem (33) past its middle position.

5. Apparatus as claimed in claim 1, characterized in that the return line connected downstream from the filter (23) to the hydraulic aggregate (2) comprises a spring-biased non-return valve (22) for generating a back pressure.

6. Apparatus as claimed in claim 1, characterized in that the cylinder structure (8), including the pilot means (17; 18–22) and filter (23), is mounted as an integral unit (3).

* * * * *